US005517079A

United States Patent [19]

Seder et al.

[11] Patent Number: 5,517,079

[45] Date of Patent: May 14, 1996

[54] DUAL FILAMENT FLUORESCENT LAMP FOR AVOINICS LIQUID CRYSTAL DISPLAYS

[75] Inventors: Thomas A. Seder; Brian P. Dehmlow; David F. Beat, all of Cedar Rapids, Iowa

[73] Assignee: Rockwell International Corporation, Seal Beach, Calif.

[21] Appl. No.: 400,690

[22] Filed: Mar. 8, 1995

Related U.S. Application Data

[63] Continuation of Ser. No. 986,643, Dec. 8, 1992, abandoned.

[51] Int. Cl.[6] ..... H01J 61/067

[52] U.S. Cl. ..... 313/491; 313/492; 313/574; 340/642

[58] Field of Search ..... 313/491–492, 313/577, 574, 631, 343, 1, 316, 272; 340/642; 362/224, 225

[56] References Cited

U.S. PATENT DOCUMENTS

| | | | |
|---|---|---|---|
| 2,814,748 | 11/1957 | Cox | 313/492 |
| 3,215,881 | 11/1965 | Waymouth | 313/492 |
| 3,328,622 | 6/1967 | Toomey | 313/491 |
| 3,356,883 | 12/1967 | Menelly et al. | 313/491 |
| 3,898,503 | 8/1975 | Shurgan | 313/492 X |
| 4,734,616 | 3/1988 | Northrop | 313/492 |
| 4,866,339 | 9/1989 | Budinger et al. | 313/492 |
| 5,296,783 | 3/1994 | Fischer | 313/549 X |

FOREIGN PATENT DOCUMENTS

| | | | |
|---|---|---|---|
| 0514376 | 6/1976 | U.S.S.R. | 313/491 |

*Primary Examiner*—Sandra L. O'Shea
*Assistant Examiner*—Ashok Patel
*Attorney, Agent, or Firm*—Gregory G. Williams; M. Lee Murrah; George A. Montanye

[57] ABSTRACT

A dual filament fluorescent lamp where the individual filaments are disposed along diameter lines of a fluorescent tube and are disposed on differing planes at differing heights within the tube with a predetermined separation between the tube filaments and the filaments being disposed in a perpendicular fashion when viewed from above. The primary filament is disposed above the secondary filament and it has a larger diameter that the secondary filament.

4 Claims, 1 Drawing Sheet

FIG. 1A PRIOR ART
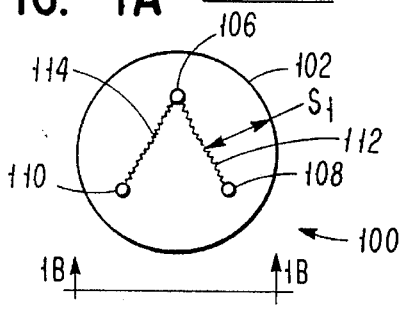
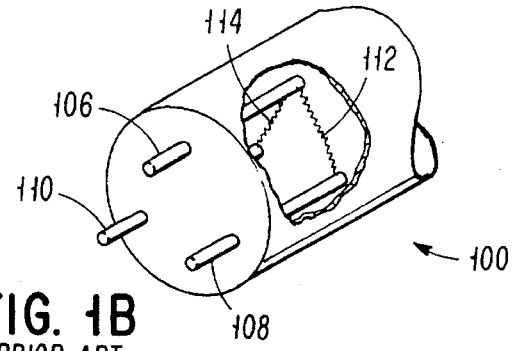
FIG. 1B
PRIOR ART
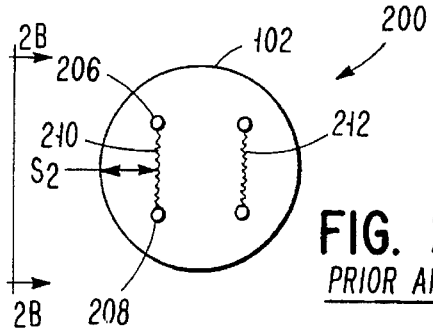
FIG. 2A
PRIOR ART
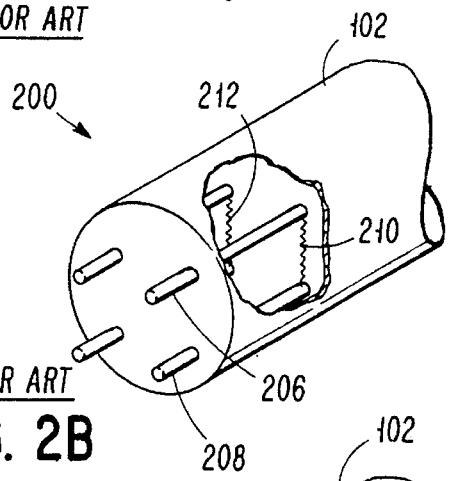
PRIOR ART
FIG. 2B
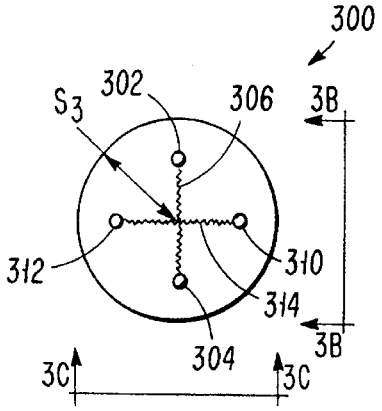
FIG. 3A
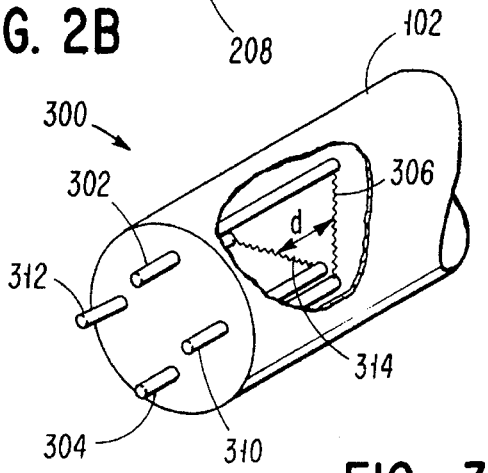
FIG. 3B
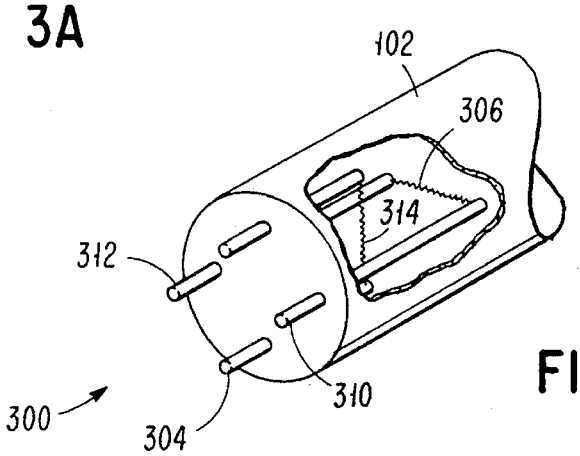
FIG. 3C

DUAL FILAMENT FLUORESCENT LAMP FOR AVOINICS LIQUID CRYSTAL DISPLAYS

This application is a File Wrapper Continuation of application Ser. No. 07/986,643 filed Dec. 8, 1992, now abandoned.

FIELD OF THE INVENTION

The present invention generally relates to fluorescent lamps, and more particularly relates to fluorescent lamps for avionics liquid crystal displays, and even more particularly concerns a long life fluorescent lamp for such displays.

BACKGROUND OF THE INVENTION

In the past, avionics engineers have attempted to extend the life of fluorescent lamps used to backlight liquid crystal displays in aircraft. The complete failure of a lamp could be catastrophic and at the least it requires much effort in bulb replacement. Consequently, it is desirable to extend the life of fluorescent lamps for avionics displays.

One attempt that has been utilized in the past is a dual filament approach where if one filament fails another remains. Typically, these filaments have a common terminal and are arranged in a "V" shape in one plane. Another frequent application has been to utilize two parallel filaments in the same plane. While these designs have enjoyed considerable acceptance in the industry, they have several serious drawbacks. First of all, the "V" shape suffers from the occasional tendency of a broken filament to damage the unbroken filament. Secondly, both the "V" shaped design and the parallel filament design suffer from a reduction in filament life due to the transport of material from the filament to the glass wall (evaporation/deposition). This "pumping" reduces filament life by accelerating the loss rate of emissive material. Emissive material loss rate is minimized if the filament-wall distance is maximized, that is, if the filament is centrally positioned along a diameter of the glass tube. Since current dual filament designs do not possess this attribute, there exists a need for improvement in fluorescent lamps for avionics displays.

Consequently there exists a need for improvement in fluorescent lamps for avionics displays.

SUMMARY OF THE INVENTION

It is an object of the present invention to provide a long life fluorescent lamp.

It is a feature of the present invention to include a primary filament extending across a diameter of the tube.

It is an advantage of the present invention to increase the overall distance between the filament and the tube walls.

It is another object of the present invention to provide a reliable fluorescent lamp for avionics displays.

It is another feature of the present invention to include a second filament extending across a diameter of the tube.

It is another advantage of the present invention to provide a backup filament in the event of the failure of the primary filament.

It is yet another object of the present invention to minimize the detrimental affect on the primary filament caused by the secondary filament.

It is yet another feature of the present invention to utilize a smaller filament as a secondary filament.

It is yet another advantage of the present invention to reduce pumping from the primary filament to the secondary filament.

It is still another objective of the present invention to minimize the detrimental affect on the secondary filament caused by the primary filament.

It is still another feature of the present invention to dispose the primary filament and the secondary filament in a perpendicular fashion on separate planes.

It is still another advantage of the present invention to have the broken primary filament not block the electron flow of the secondary filament and for the broken primary filament not to contact the secondary filament.

The present invention provides an improved fluorescent lamp which is designed to satisfy the aforementioned needs, produce the earlier mentioned objects, contain the above described features and achieve the previously stated advantages. The invention is carried out in a "pumping-less" fashion, in the sense that the high level of pumping associated with two filaments positioned in a single plane on nondiameter lines, is reduced. Instead, both the primary filament and the secondary filament are positioned across the width of the tube on a diameter line with the primary filament and the secondary filament being disposed in two separate planes.

Accordingly, the present invention relates to a fluorescent tube having a circular cross section in a primary filament extending across the tube through a diameter of the tube and a secondary filament extending across the diameter of the tube wherein the primary filament and the secondary filament are disposed on separate planes.

BRIEF DESCRIPTION OF THE DRAWINGS

The invention may be more fully understood by reading the following detailed description in conjunction with the appended drawings wherein.

FIG. 1A is a top view of a typical dual filament fluorescent lamp tube, of the prior art which utilizes a "V" shaped filament arrangement.

FIG. 1B is a cutaway perspective view of a prior art lamp taken on line 1B—1B of FIG.1A.

FIG. 2A is a top view of a typical fluorescent lamp having a parallel filament configuration of the prior art.

FIG. 2B is a cutaway perspective view of a prior art lamp taken on line 2B—2B of FIG. 2A.

FIG. 3A is a top view of the fluorescent lamp, of the present invention, showing two filaments extending across the tube along diameter lines.

FIG. 3B is a cutaway perspective view, of the lamp of the present invention, taken on line 3B—3B of FIG. 3A.

FIG. 3C is a cutaway perspective view of the lamp of the present invention taken on line 3C—3C of FIG. 3A.

DETAILED DESCRIPTION

Now referring to the drawings where like numerals refer to like structure throughout.

Referring more particularly to FIG. 1A, there is shown a top view of a prior art fluorescent lamp, generally designated 100, having a fluorescent tube 102 with a first filament 112 and a second filament 114 disposed therein. Filament 112 spans between post 106 and post 108 while filament 114 spans between post 110 and post 106. Post 106 is common to both filaments 112 and 114.

Now referring to FIG. 1B, there is shown a cutaway perspective view of the fluorescent tube taken on line 1B—1B of FIG. 1A which is a generally designated 100, having a fluorescent tube 102 with portions removed to allow for additional visibility, post 106 disposed centrally between post 108 and post 110. Filaments 112 and 114 are shown extending from post 106 to posts 108 and 110 respectively.

Now referring to FIG. 2A, there is shown a fluorescent lamp, of the prior art, generally designated 200, including a fluorescent tube 102 and a first filament 210 and a second filament 212. The filament 210 is shown extending between posts 206 and 208.

Now referring to FIG. 2B, there is shown a cutaway perspective view of a prior art fluorescent tube taken on line 2B—2B of FIG. 2A, generally designated 200 having a fluorescent tube 102 and a post 206 and 208 with filament 210 extending there between. Filament 212 is partially shown in FIG. 2B due to its placement behind post 206.

Now referring to FIG. 3A, there is shown a top view of a fluorescent lamp, of the present invention, generally designated 300, including a tube 102 having a first or primary filament 306 disposed therein and a second or secondary filament 314 disposed therein. Filament 306 is shown extending between post 302 and post 304 while filament 314 is shown extending between post 312 and 310. From the top view the filaments 306 and 314 are perpendicular with respect to each other.

First filament 306 in a preferred embodiment has a diameter larger than the diameter of said second filament 314.

Now referring to FIG. 3B, there is shown a cutaway perspective view of the fluorescent lamp generally designated 300, of the present invention, taken on line 3B—3B of FIG. 3A, having a tube 102, a filament 306 and a filament 314. Filament 306 is shown coupled with post 304 and 302 while filament 314 is shown coupled with post 310 and 312. There also is shown a dimension d which represents the distance between the filament 306 and the filament 314. FIG. 3B demonstrates that filaments 306 and 314 are in separate planes and are not intersecting in any way. Additionally, the dimension d is selected so that if the filament 306 breaks and remains attached to the posts 304 or 302 and swings downward it will not contact filament 314.

Now referring to FIG. 3C, there is shown another side cutaway perspective view of the fluorescent lamp, of the present invention, generally designated 300 taken along line 3C—3C of FIG. 3A which shows filament 306 disposed centrally within the tube 102. The filament 314 is shown spanning between posts 312 and 310.

Now referring to FIGS. 1A, 2A, and 3A, there are shown distances $S_1$, $S_2$, and $S_3$ respectively. These distances are measured to the center of the respective stick filament. These distances represent the distance between the electrode midpoints and the sidewall of the tube 102. Since the filament 310 in FIG. 3A is disposed down the center of the tube 102 along a diameter line the distance $S_3$ is greater than either the distance $S_1$ or $S_2$ because in FIGS. 1A and 2A the filaments 112 and 210 respectively are not disposed along a diameter line of the tube 102. It is this increased separation distance of $S_3$ of FIG. 3A that provides for some of the enhanced filament life of filament 314, relative to filaments 114, 112, 210 and 212. The pumping of emissive material from the filament 314 and the wall 102 is inversely proportional to the distance therebetween. The smaller volume of second filament 314 creates a smaller object for pumping and thereby reduces transport rate and increases the life of first filament 306. The distance $S_3$ of FIG. 3C represents the distance between the filament 306 disposed down a diameter line of the tube 102 and the tube wall. The present design is optimal when the second filament 314 is much smaller than the primary filament 306. In this case the transport of evaporated material between the two filaments is minimized. Further, for avionics application, the second filament 314 is intended to only allow a pilot to complete his/her mission with full use of the fluorescent lamp backlit instrument. It is preferred that the secondary filament does not have identical performance attributes as the primary filament. Such designs compromise the performance of the primary filament.

Since filaments 306 and 314 of FIG. 3A have different masses of cathodic material, the filament processing schedules used to convert the alkaline earth carbonate material into the emissive alkaline earth oxide material, are necessarily different. Thus, lamp processing machinery having the capability of sequentially applying two different filament processing schedules is required to implement the present invention. In practice, since organic materials are released from the filament upon cathode conversion (activation), and organic materials react with alkaline earth oxides, it is necessary to activate the secondary filament 314 prior to activating the primary filament 306. In this way, the performance of the primary filament 306 is not comprised via reaction with materials driven from filament 314 activation. The reaction of materials generated during subsequently activation of primary filament 306 with the secondary filament 314 is minimized by flushing the lamp with a noble gas during the activation process (flow through processing).

It is believed that the fluorescent tube, of the present invention, and many of its attendant advantages will be understood by the foregoing description, and it will be apparent that various changes may be made in the form, construction and arrangement of the parts thereof without departing from the spirit and scope of the invention or sacrificing all of its material advantages. The form herein before described being merely an explanatory embodiment thereof. It is the intention of the following claims to encompass and include such changes.

We claim:

1. A fluorescent lamp comprising:

a bulb having a first end and a second end;

said first end having a first filament and a means for providing a second filament for use as a backup when said first filament fails;

said first filament disposed along a first diameter line of the bulb in a first plane;

said means for providing a second filament disposed in a second plane; and, wherein said first filament and said means for providing a second filament are separated by a minimum distance of one-half the diameter of bulb.

2. A fluorescent lamp comprising;

a glass tube having a first end and a second end;

a first end primary filament disposed in said first end of said glass tube;

a first end secondary filament disposed in said first end of said glass tube;

said first end primary filament disposed along a diameter line of the tube in a first end primary plane;

said first end secondary filament disposed along a diameter line of the tube in a first end secondary plane;

said first end primary filament and second end primary filament being separately disposed within said tube; and, said primary filament and said secondary filament are perpendicular.

3. A fluorescent lamp comprising;

a bulb having a first end and a second end;

said first end having a first filament and a second filament;

said first filament disposed along a first diameter line of the bulb in a first plane;

said second filament disposed in a second plane;

said second filament being disposed on a second diameter line of the bulb; and, said first filament and said second filament are perpendicular.

4. A lamp of claim 3, wherein said second filament has a smaller diameter than said first filament.

* * * * *